United States Patent [19]
Farrer-Halls
[11] 4,318,274
[45] Mar. 9, 1982

[54] GAS-OPERATED MOTORS

[75] Inventor: James A. Farrer-Halls, Hurst, England

[73] Assignee: BOC Limited, London, England

[21] Appl. No.: 25,692

[22] Filed: Mar. 30, 1979

[51] Int. Cl.³ ..... F01K 25/10
[52] U.S. Cl. ..... 60/671; 60/509; 60/659; 60/669
[58] Field of Search ..... 60/508, 509, 651, 671, 60/659, 669; 165/104.5

[56] References Cited

U.S. PATENT DOCUMENTS

| | | | |
|---|---|---|---|
| 3,080,706 | 3/1963 | Flynn, Jr. | 60/659 |
| 3,576,424 | 4/1971 | Strapp | 60/659 |
| 4,092,830 | 6/1978 | Rilett | 60/671 |
| 4,126,995 | 11/1978 | Asselman | 60/659 X |

*Primary Examiner*—Allen M. Ostrager
*Attorney, Agent, or Firm*—David L. Rae; Larry R. Cassett

[57] ABSTRACT

A gas-operated motor adapted to be driven by gas evaporated from a reservoir of liquefied carbon dioxide or the like. In order to overcome the problems generally associated with such motors due to the cooling of the gas as it evaporates from the liquid state in the reservoir and expands in the working chamber(s) of the motor, a chamber holding a substance which undergoes a change of state to release heat to the gas in operation of the motor is included. More particularly this chamber is located to be in heat conductive relationship both with the working chamber(s) of the motor and with a tortuous passage through which gas is supplied to the working chamber(s) and wherein superheating of the gas prior to its introduction to the working chamber(s) takes place.

9 Claims, 1 Drawing Figure

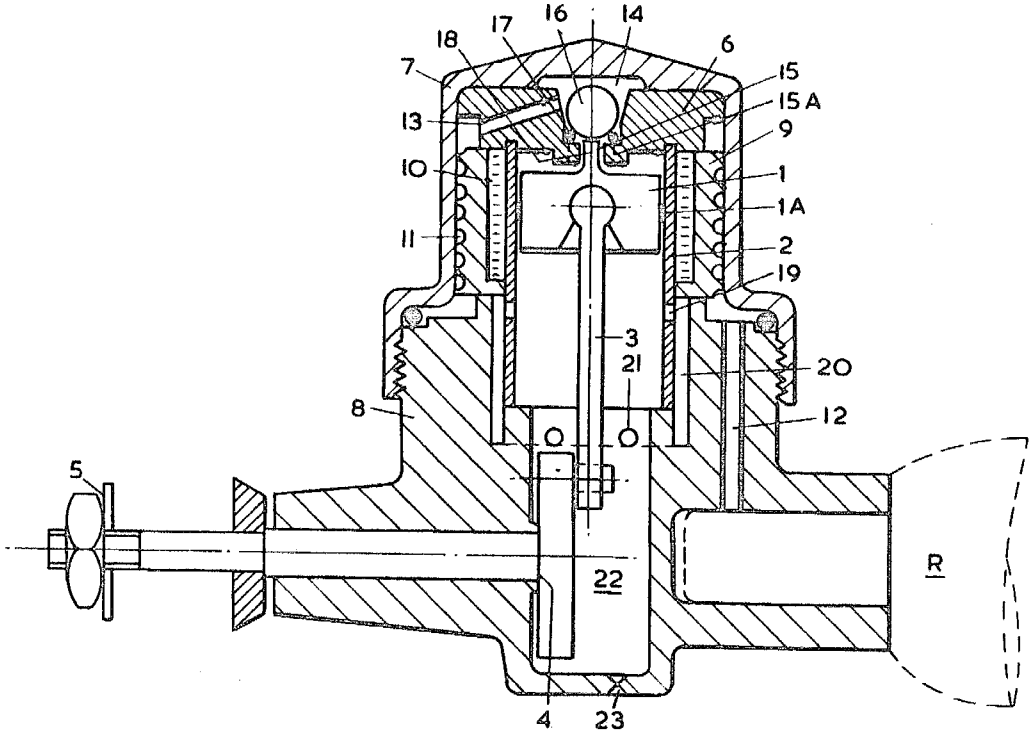
R
20
12
15
15A
9
1
1A
2
19
6
14
3
21
22
23
16
4
17
18
7
13
10
11
8
5

GAS-OPERATED MOTORS

FIELD OF THE INVENTION

The present invention is concerned with gas operated motors, and more particularly motors for which the gas supply comprises a reservoir of pressure liquefied carbon dioxide or the like.

BACKGROUND OF THE INVENTION

Model aircraft motors adapted to be driven by gas evaporated from a reservoir of liquefied carbon dioxide, such as may be provided e.g. by a capsule of the type marketed by the present applicants under the registered trademark SPARKLETS, are already known. However, a major difficulty which arises with existing motors of this type is the progressive fall in gas pressure which occurs as gas flows from the reservoir in order to drive the motor, and which limits the power of the motor to a rather low level. This fall in pressure is a consequence of the cooling of the gas as it attempts to evaporate from the liquid state in the reservoir and to expand during consumption by the motor. This cooling effect becomes worse as one attempts to increase the speed and power of the motor and can even cause formation of ice on the outside of the reservoir vessel. Furthermore the cooling of the gas causes its density to increase with the result that gas consumption is increased undesirably. A further disadvantage of existing motors of this type arises because the gas taken from the reservoir for such existing motors is at or near the condition known as 'saturation' with the consequence that, as soon as it is expanded in the motor, it inevitably condenses partly back into its liquid or even its solid state. Apart from the possibility of damage to the motor such condensation also causes a large increase in the specific volume of the working fluid and this requires that the motor should have a high expansion ratio in order to adequately expand the working fluid and so extract its available energy. This in turn leads to the need for an undesirably large motor, or to an undesirably low charge volume (which reduces motor power), or to the need for excessively high rpm in order to secure sufficient power from the motor.

In order to overcome these problems it is proposed in U.S. Pat. No. 4,092,830 to provide a container holding or capable of being charged with a buffer substance in heat conductive relationship with the reservoir or with a passage through which, in operation, the gas is supplied from the reservoir to the motor. By the term 'buffer substance' in this specification is meant a substance which undergoes a change in its physical, chemical, crystallographic or other state during operation of the motor, the change of state causing a release of heat to the gas. The choice and effects of suitable buffer substances are discussed in the U.S. Patent mentioned above, the disclosure of which is incorporated herein by reference.

Motors which make use of this buffering technique can conveniently be referred to as 'stored energy motors' because their buffer substances effectively store heat energy which is released to the working fluid for conversion into power as the motor runs. It is to this class of motor that the present invention relates, an aim of the invention being to provide a motor in which the efficacy of buffering is improved over those designs of stored energy motors hitherto proposed. The invention will be described hereinafter in terms of a motor for powering model aircraft, although it is to be noted that motors in accordance with the invention may be found equally useful in many other applications, e.g. for driving other toys and models, portable power tools, hedge trimmers, dentists' drills, lawn mowers and the like, and in various light automative applications.

SUMMARY OF THE INVENTION

The invention resides in a gas operated motor including a chamber holding or capable of being charged with a buffer substance in heat conductive relationship both with the working chamber(s) of the motor wherein gas expansion takes place in operation of the motor, and with a tortuous passage through which gas is supplied to said working chamber(s) and wherein superheating of the gas prior to its introduction to the working chamber(s) takes place in operation of the motor.

By the term 'superheating' in this context is meant a process whereby the temperature of the gas is increased at a sensibly constant pressure or whereby the pressure of the gas is reduced at sensibly constant temperature, or any combination of these two processes—i.e. effectively an increase in gas temperature and a decrease in gas pressure, which in practice is to be preferred. For example it is considered desirable for the length and bore of the aforesaid passage to be such as to induce a pressure drop in the supplied gas of at least 10% of the saturation pressure of the liquid gas in the associated reservoir at the prevailing temperature. It is recognised that such superheating is of value not only in reducing the incidence of condensation of the gas when subsequently expanded in the working chamber(s) but also in permitting, to advantage, a lower expansion ratio to be employed than would otherwise be possible and in stabilising the running speed of the motor.

In addition, the provision of a buffer in heat conductive relationship with the working chamber(s) in a motor according to the invention means that heat can flow to the gas even as it expands in the working chamber(s), reducing still further the incidence of condensation and increasing the power and economy of the motor. Moreover, the gas expanding in the working chamber(s) of a motor according to the invention can rapidly trigger the change of state of the buffer substance on start-up of the motor, thereby enabling the motor to achieve maximum power and economical running in a very short time.

BRIEF DESCRIPTION OF THE DRAWING

A preferred embodiment of a motor in accordance with the invention will now be more particularly described, by way of example, with referece to the accompanying drawing which is a schematic section through a portion of the motor.

DESCRIPTION OF THE PREFERRED EMBODIMENT

The illustrated motor is a single-cylinder reciprocating piston motor for powering a model aircraft and is adapted to be driven by gas evaporated from a reservoir of liquefied carbon dioxide. Its piston 1 reciprocates within a cylinder liner 2 against which the piston is sealed by a moulded-on ring 1A, and the piston is linked by a connecting rod 3 to a crankshaft 4 having means 5 for mounting a propeller (not shown). The head of the cylinder is defined by an annular member 6 which in the assembled motor is clamped, together with liner 2, between two screw-threadedly engaged body members 7 and 8. Likewise clamped between the body members is an annular member 9. The radially inner surface of member 9 is recessed to define with liner 2 an annular chamber which is charged with a 'latent heat' type buffer substance 10 on assembly of the motor, while the radially outer surface of member 9 is provided with a helical formation in the nature of a truncated screw thread, so as to define with the cylindrical inner surface of body member 7 a helical passage 11.

At its lower end (in the sense of the drawing) passage 11 connects with a passage 12 provided in body member 8 which latter, in use, is supplied with gaseous carbon dioxide derived from a reservoir of the liquefied gas notionally indicated as R. The gas supply may take any convenient form and may, for example, comprise a buffered refillable or disposable reservoir of liquid carbon dioxide of a type described in U.S. Pat. No. 4,092,830. At its opposite end, passage 11 connects with a passage 13 provided in member 6 which leads to a chamber 14 defined between the cylinder head and the domed end of body member 7. Chamber 14 can communicate with the working chamber of the motor through the central aperture 15 of the cylinder head. A series of grooves 15A are also provided through the central portion of member 6 in order to increase the available area for gas flow into the working chamber. In use aperture 15/grooves 15A are closed by a valve comprising a ball 16 which is urged by the gas pressure within chamber 14 to seat against an O-ring 17 encircling the mouth of the aperture/grooves. However the valve is opened to admit gas to the working chamber when the ball 16 is unseated by a projection 18 on the top of the piston 1 which abuts the ball while the piston is completing its return stroke and commencing its working stroke.

At the end of the working stroke of the piston ports 19 provided through the wall of the liner 2 are uncovered and the expanding gas exhausts from the working chamber through these ports and into an annular chamber 20 defined between the liner and body member 8. From chamber 20 the exhaust gas is lead through ports 21 provided in body member 8 and into the crank case 22 whence it is vented to atmosphere through an outlet 23. By passing the exhaust gas through the crank case in this way the gas pressure on either side of the piston 1 will tend to equalise and thereby reduce the amount of flywheel energy, obtained largely from the driven propeller, required to overcome the pumping action in the working chamber as the piston makes its return stroke.

Members 2, 7 and 9 of the motor are made from a metal of relatively high thermal conductivity, to ensure that there is a good heat flow from the buffer 10 to the working chamber and to the passage 11 in use of the motor, and also from the ambient atmosphere to the passage 11. Body member 8, on the other hand, is preferably made of a material of relatively low thermal conductivity such as nylon or the like plastics material, in order to insulate the working chamber and passage 11 from the colder reservoir of liquefied gas.

It will be appreciated that the tortuous passage 11 through which the gas must pass before it enters the working chamber acts as a superheater drawing heat from the buffer 10 and the ambient atmosphere and serving to reduce the incidence of subsequent condensation of the gas in the working chamber and stabilising the running speed of the motor. At the same time heat flows from the buffer 10 directly to the gas expanding in the working chamber, to further reduce the incidence of condensation and increase the power and economy of the motor. As previously indicated the choice of buffer substance is discussed in U.S. Pat. No. 4,092,830 and such discussion will not be repeated here. However, bearing in mind that a 'latent heat' type of buffer substance should preferably melt by heat flow from the environment following operation of the motor, liquids having freezing points within the approximate range −10° to +20° C. may be found to be most suitable. For example acetic acid may be used, giving a buffered temperature of 16° C., while the reservoir of liquid gas is buffered by water at 0°.

Although the invention has been described in the form of a single cylinder reciprocatory piston motor the principles of the invention may be found useful in relation to single or multi cylinder reciprocatory or rotary piston motors, or indeed to any type of stored energy gas-expansion motor, including both positive displacement and turbine types. Furthermore, various alternatives to carbon dioxide as the working fluid may be employed, for example nitrous oxide.

It will be appreciated that the form of construction illustrated in the accompanying drawing, while providing a motor having the advantages described above is nevertheless uncomplicated and readily lends itself to automatic assembly techniques; all of the assembly operations are axial in relation to the centre line of the working chamber and all major components are self-locating and locked together by the single screwthreaded connection between body members 7 and 8. In a modification of the illustrated motor, the envelope of the motor is generally symmetrical about the axis of the crank shaft with the liquid gas reservoir mounted in a position facing the working chamber. In such a case the exhaust gas would be ported not through the outlet 23 but through an aperture in the rear of the crank case.

I claim:

1. A gas operated motor comprising means for defining a cylindrical working chamber having a piston reciprocable therein; means for defining a generally cylindrical chamber which surrounds said working chamber and is capable of being charged with a buffer substance which releases heat during operation of said motor; and means for defining a tortuous, generally helical passage in heat conductive relation with said buffer substance and which passage (1) surrounds said chamber capable of being charged with said buffer substance and (2) is in communication with said working chamber such that said gas is superheated upon being supplied through said passage in heat conductive relation with said buffer substance prior to introduction of said gas into said working chamber during operation of said motor.

2. A motor according to claim 1 wherein said working chamber is defined between a cylinder liner and a head member; said chamber capable of being charged with a buffer substance is defined at least in part between said cylinder liner and an annular member which surrounds the cylinder liner; said cylinder liner, head member and annular member being clamped together between a pair of mating body members; and with said tortuous passage being defined at least in part between said annular member and a portion of one of the body members.

3. A motor according to claim 1 wherein said working chamber has a head including a gas inlet valve normally closed under the pressure of gas supplied to that side of the valve remote from the working chamber, but which can be opened to admit gas to the working chamber by the abutment of an actuating member carried by the piston, when the piston is towards the top of its stroke.

4. A motor according to claim 1 wherein said working chamber has one or more exhaust ports through its wall which are uncovered by the piston to permit the exhaust of gas from said working chamber when the piston is towards the bottom of its stroke.

5. A motor according to claim 4 having passage means whereby gas exhausted from said working chamber is ducted to the trailing side of the piston so as to assist the piston in making its return stroke.

6. A motor according to claim 1 wherein said buffer substance has a freezing point in the range −10° to +20° C.

7. A motor according to claim 6 wherein said buffer substance is acetic acid.

8. A gas-operated motor according to claim 1 in combination with a reservoir vessel capable of being charged with liquified gas, and means for supplying gas evaporated from said reservoir vessel to the working chamber of the motor via said tortuous passage.

9. A combination according to claim 8 wherein said reservoir vessel holds a quantity of liquefied carbon dioxide.

* * * * *